US006749073B2

(12) United States Patent
McNab

(10) Patent No.: US 6,749,073 B2
(45) Date of Patent: Jun. 15, 2004

(54) UTILITY RACK

(76) Inventor: Amanda L. McNab, 111 Bleckley Ave., Greenville, SC (US) 29607

( * ) Notice: Subject to any disclaimer, the term of this patent is extended or adjusted under 35 U.S.C. 154(b) by 0 days.

(21) Appl. No.: 10/118,439

(22) Filed: Apr. 8, 2002

(65) Prior Publication Data

US 2002/0144961 A1 Oct. 10, 2002

Related U.S. Application Data

(60) Provisional application No. 60/282,446, filed on Apr. 9, 2001.

(51) Int. Cl.[7] ..... A47F 7/24
(52) U.S. Cl. ..... 211/85.3; 211/205
(58) Field of Search ..... 211/85.3, 205; D6/411

(56) References Cited

U.S. PATENT DOCUMENTS

| | | | | | |
|---|---|---|---|---|---|
| 357,554 | A | | 2/1887 | Goodrich et al. | |
| 1,386,775 | A | | 8/1921 | Fulford | |
| 1,804,069 | A | | 5/1931 | Stover | |
| D156,022 | S | | 11/1949 | Mannheimer | |
| D195,572 | S | | 7/1963 | Gleitsman | |
| 3,310,180 | A | * | 3/1967 | Neagle | 211/205 |
| D300,289 | S | | 3/1989 | Walter | D6/411 |
| D301,094 | S | | 5/1989 | Muxlow | D6/411 |
| 4,877,140 | A | | 10/1989 | Lee | 211/163 |
| 5,318,175 | A | * | 6/1994 | Stevens | 211/205 |
| 5,348,165 | A | | 9/1994 | Pomerleau | 211/13 |
| 5,566,837 | A | | 10/1996 | Lema | 211/33 |
| D395,895 | S | * | 7/1998 | Flinn | D14/229 |
| 5,823,360 | A | * | 10/1998 | Gorosave | 211/13.1 |
| 5,906,284 | A | | 5/1999 | Hemmerstrom et al. | 211/205 |
| D410,804 | S | | 6/1999 | Murray | D6/455 |
| 6,036,034 | A | * | 3/2000 | Battaglia et al. | 211/187 |

* cited by examiner

*Primary Examiner*—Daniel P. Stodola
*Assistant Examiner*—Erica B. Harris
(74) *Attorney, Agent, or Firm*—McNair Law Firm, P.A.

(57) ABSTRACT

A utility rack for organizing and storing a variety of clothing and accessory items commonly worn and used by law enforcement personnel. The utility rack includes several apparel supports and accessory supports, and more specifically, the utility rack includes a shoe-rack, radio support, microphone mount, apparel hook, hat-rack, utility belt hanger, vest hanger, and storage box all carried on an elongated post affixed to a base with adjustable footing for leveling the rack. The apparel supports and accessory supports are disposed at various levels along the height of the post for organizing the clothing and accessory items in a functional arrangement generally related to the manner in which the items are usually donned and removed.

21 Claims, 2 Drawing Sheets

UTILITY RACK

This application claims the benefit of Provisional Application Ser. No. 60/282,446, filed Apr. 9, 2001.

FIELD OF THE INVENTION

This invention relates to a utility rack for organizing and storing clothing and accessory items, and more particularly, to a utility rack having for organizing and storing the clothing and accessory items used by law enforcement personnel, emergency personnel, and the like in a functional arrangement generally related to the manner in which the items are usually donned and removed.

BACKGROUND OF THE INVENTION

Today's police officers, emergency personnel, and other law enforcement personnel, are required to wear on their uniforms or carry with them more accessories then ever before. For example, most jurisdictions require each of its officers to wear bulletproof vests, carry a police two-way radio, and other specialized equipment such as batons, extra ammunition, or mace. Primarily, these accessories are worn on the body, contained in pockets, or attached to utility belts. A typical police officer would be outfitted with a bulletproof vest, firearm, flashlight, extra ammunition, two-way radio, handcuffs, writing instrument, pad of paper, mace, baton, keys, uniform, and headwear, such as an 8-point hat, or ball cap. When an officer is off duty, storage of all these accessories causes a significant problem to which little consideration has previously been directed.

An examination of the prior art shows that there has been no single invention that meets the needs of the modern day police officer for organizing and storing all the required clothing and accessory items in a single place. For example, U.S. Pat. No. 1,386,775 provides for a coat hanger suspended from a bar affixed to a wall that includes a shoe-rack. The device is intended to hang shirts and pants exclusively, and is not designed to support a variety of additional accessories. This device provides no means for supporting accessories such as a bulletproof vest, utility belt, two-way radio and the variety of other components used by today's law enforcement personnel. The same is true for U.S. Pat. Nos. 1,804,069; 357,554; and 5,348,165, all of which fail to provide the specific support and organizational needs for the large amounts of accessories worn by today's law enforcement personnel. U.S. Pat. No. 5,348,165 is specifically directed toward supporting water-dripping gear for firefighters and fails to provide sufficient hanging capacity to meet the needs for law enforcement personnel. The same is true for U.S. Pat. Nos. 1,804,069; 357,554; and 5,348,165, all of which fail to provide the specific support and organizational needs for the large amounts of accessories worn by today's law enforcement personnel. U.S. Pat. No. 5,348,165 is specifically directed toward supporting water-dripping gear for firefighters and fails to provide sufficient hanging capacity to meet the needs for law enforcement personnel.

Accordingly, it is an object of the present invention to provide a utility rack adapted to organize and store the specific clothing and accessory items required to be carried by law enforcement personnel, emergency personnel, and the like.

It is an object of the present invention to provide a utility rack for organizing and storing a variety of clothing and accessory items in such a manner that an individual may quickly retrieve or hang clothing and accessory items according to a logical order in which the items may be conveniently removed or donned when dressing.

SUMMARY OF THE INVENTION

The above objectives are accomplished according to the present invention by providing a utility rack for organizing and storing a variety of clothing and accessory items worn and carried by law enforcement personnel, emergency personnel and the like. In a preferred embodiment, the utility rack is comprised of a base with an elongated post carried by the base. The post includes an upper level, a medial level, and a lower level for organizing the clothing and accessories.

Advantageously, a plurality of apparel supports are carried by the post along the height of the post for organizing the clothing in a functional arrangement. In the preferred embodiment, the apparel supports include a hat-rack carried by the post adjacent the upper level for storing headwear at a position generally correlated to where the headwear is worn. Preferably, the apparel supports also include at least one apparel hook carried by the post below the hat-rack and generally above the medial level for hanging clothing without interfering in the arrangement of other clothing and accessory items. In a further advantageous embodiment, the apparel supports further include a shoe-rack carried by the post near the lower level for storing footwear at a position that generally corresponds to the level of where the footwear is worn in order to facilitate storage of the footwear.

Advantageously, a plurality of accessory supports are carried by the post along the height of the post for organizing the accessory items in a functional arrangement. In the preferred embodiment, the accessory supports include a radio support carried by the post above the shoe-rack for storing a radio at a convenient location for charging. Preferably, the accessory supports also include a microphone mount carried by the post adjacent the radio support for storing a microphone operatively associated with the radio. In a further advantageous embodiment, a utility belt hanger is carried by the post below the hat-rack and generally above the medial level for storing a utility belt clear of the clothing. Additionally, this further advantageous embodiment includes a vest hanger carried by the post near the medial level for storing a bulletproof vest without interfering in the arrangement of other clothing and accessory items.

Advantageously, a storage box is carried by the post near the medial level for storing miscellaneous equipment normally worn on or used by the personnel. Accordingly, the apparel supports and accessory supports are disposed at various levels along the height of the post for organizing clothing and accessory items in a functional arrangement generally related to the manner in which the items are usually donned and removed.

Preferably, the elongated post is of a sufficient height so as to allow the clothing and accessory items to be placed on the post in a functional vertical arrangement without overlapping.

In an further advantageous embodiment, the hat-rack includes a horizontal hat platform affixed to a top end of the post for storing the headwear. Preferably, a plurality of apparel hooks are carried below the horizontal hat platform and generally above the medial level for storing the clothing in a vertically arranged manner to accommodate hanging and removing the clothing in a prescribed sequence. The apparel hooks includes a first apparel hook for hanging a first clothing item and a second apparel hoop for hanging a second clothing item. The first and second apparel hooks are functionally arranged so that the clothing may be placed on the apparel hooks in an order to facilitate removal of the clothing in a reverse order when dressing. Preferably, the utility belt hanger is carried on an opposite side of the post from the apparel hooks to balance the weight of items hanging on the post between the hat-rack and the medial level. Advantageously, the utility belt hanger carries the utility belt at least 48 inches above the ground to prevent small children from reaching the utility belt.

Preferably, the vest hanger is carried by the post below the storage box and above the base. In the preferred embodiment, the vest hanger includes a hanger bar extending across the post for hanging the bulletproof vest which has a weight heaver than the clothing placed on the apparel hook. The hanger bar is disposed on an opposite side of the post from the radio support and shoe-rack for carrying the bulletproof vest between the medial level and the base to reduce the likelihood of tipping from the weight of the bulletproof vest.

Preferably, the radio support is carried by the post above the shoe-rack a sufficient height to allow the footwear to be placed on the shoe-rack clear of the radio support. In the preferred embodiment, the radio support is adapted for carrying a charging unit used to charge the radio. Accordingly, the radio support is located at a height on the post so as to be in proximity to a wall power outlet so that a power cord of the charging unit may be connected to the wall power outlet for charging the radio when placed in the charging unit on the radio support. Preferably, the radio support and microphone mount are carried by the post near the medial level on an opposite side of the storage box and the vest hanger. In a further advantageous embodiment, the microphone mount is carried by the post in a vertical arrangement above the radio support so that a cord connecting the microphone to the radio may be maintained in an untangled orderly manner.

Preferably, the shoe-rack includes an inclined platform carried by the post above the base near the lower level for receiving footwear. The inclined platform includes a heel ridge for abutting the heel of a shoe to prevent the shoes from falling off the inclined platform and causing injury.

Preferably, the base includes a plurality of adjustable footings for leveling the base on uneven flooring.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
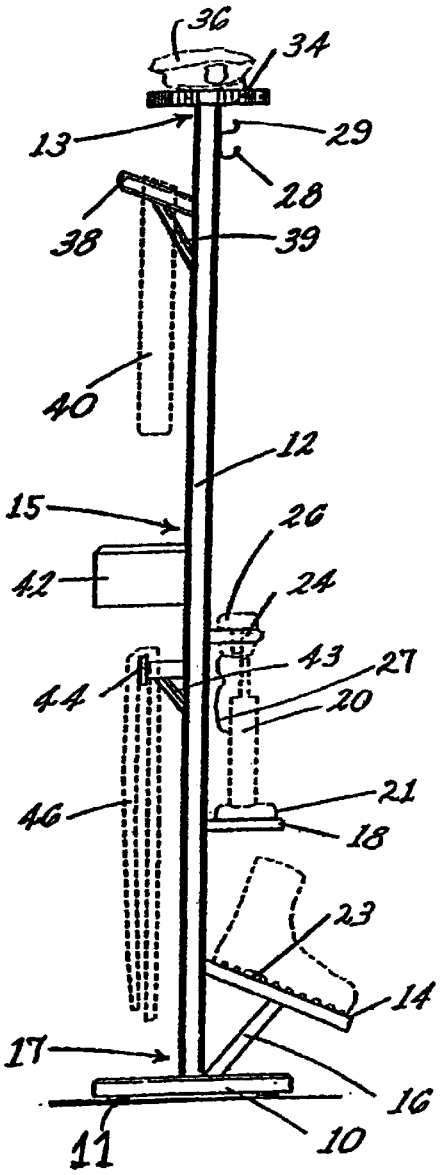
FIG. 1 is a side view of the utility rack according to the invention.
Figure 2:
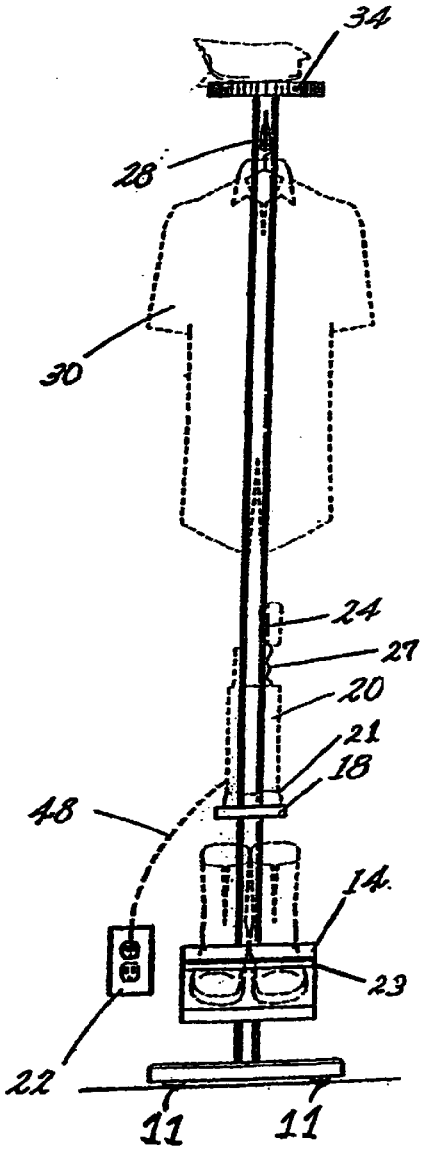
FIG. 2 is a front view of the utility rack according to the invention.

Referring now to FIGS. 1 and 2, a preferred embodiment of a utility rack is shown for organizing and storing a variety of clothing items and accessory items of the type commonly worn and used by law enforcement personnel, emergency personnel, and the like.

The rack includes a base 10 carrying an elongated post 12 in an upright position. A plurality of apparel supports and a plurality of accessory supports are disposed along the height of post 12 for organizing the clothing and accessory items in a functional arrangement generally related to the manner in which the items are usually donned and removed to facilitate storage and removal of the items, as detailed herein below. In order to correctly position the apparel and accessory supports, and ultimately the clothing and accessory items on the post, post 12 is defined as including an upper level, designated generally as area 13; a medial level, designated generally as the area 15; and a lower level designated generally as area 17. Post 12 is of a sufficient height, preferably six feet in height, so as to allow the clothing and accessory items to be placed on said post in a functional vertical arrangement without overlapping. Additionally, in the preferred embodiment, base 10 contains a plurality of adjustable footings 11 for leveling the utility rack on uneven flooring.

In the preferred embodiment, the apparel supports include a hat-rack 34, an apparel hook 28, and a shoe-rack 14 carried by post 12 at various heights, as shown in FIGS. 1 and 2.

Referring to hat-rack 34, in the preferred embodiment, hat-rack 34 is affixed to the top end of elongated post 12 adjacent upper level 13 for storing headwear, such as an 8-point hat 36 or any other uniform hats, shown in outline form in FIG. 1. Hat-rack 34 is carried atop post 12 for storing headwear at a position generally correlated to where the headwear is worn to allow for easy placement of the headwear on the hat-rack as well as removal of the headwear from the hat-rack. Preferably, hat-rack 34 is a rounded horizontal hat platform on which a hat may be placed to prevent the hat from being bent or otherwise deformed when not being worn. However, hat-rack 34 shown in FIG. 1 is for illustrative purposes of the preferred embodiment and is not limited to such a horizontal hat platform. Rather, it is understood that hat-rack 34 includes any type of rack or shelf, with or without hooks that may be affixed to the top of post 12, which may be used to hold a single hat or a plurality of hats worn by law enforcement personnel, emergency personnel, and the like.

Referring to apparel hook 28, in the preferred embodiment, apparel hook 28 is affixed to post 12 below hat-rack 34 and generally above medial level 15 for hanging clothing without interfering in the arrangement of other clothing and accessory items. As shown in FIGS. 1 and 2, preferably apparel hook 28 is disposed in the area of upper level 13 at a sufficient height to allow a uniform 30, shown in outline form in FIG. 2, to be suspended from apparel hook 28 and hang freely so as not to be wrinkled by other equipment carried by elongated post 12. Generally, apparel hook 28 is of sufficient size and strength to hold at least one shirt, pants, and a jacket for the typical policeman's uniform, typically between twenty-four and forty-five inches in length. It should be noted that while the apparel hook is intended to hang shirts and pants, a ball cap and other miscellaneous apparel items can be placed on apparel hook 28 along with uniform 30. In the preferred embodiment, a plurality of apparel hooks are carried below hat-rack 34 and generally above medial level 15 for storing the clothing in a vertically arranged manner to accommodate hanging and removing the clothing in a prescribed sequence. Preferably, the apparel hooks includes a first apparel hook 29 for hanging a first clothing item and a second apparel hook 28 for hanging a second clothing item. The first and second apparel hooks are functionally arranged so that the clothing may be placed on the apparel hooks in an order to facilitate removal of the clothing in a reverse order when dressing.

Referring to shoe-rack 14 shown in FIGS. 1 and 2, in me preferred embodiment, shoe-rack 14 is carried by elongated post 12 near lower level 17 for storing footwear at a position that generally corresponds to the level of where the footwear is worn in order to accommodate the weight of the footwear and facilitate storage of said footwear. Preferably, shoe-rack 14 includes an inclined platform carried by post 12 above base 10 near lower level 17 for receiving footwear, shown in outline form resting on the shoe-rack. The inclined platform includes a heel ridge 23 for abutting the heel of a shoe to prevent the shoes from sliding down and falling off the inclined platform, which may cause injury. Preferably, a shoe-rack support leg 16 extends between inclined platform 14 and base 10 to provide additional structural rigidity and support beneath the shoe-rack for heavy shoes. It is understood, however, that constructing the utility rack from a strong material such as metal may eliminate the need for support leg 16 and is within the spirit and scope of the present invention.

In the preferred embodiment, the accessory supports include a radio support 18, a microphone mount 24, a utility belt hanger 38, and a vest hanger 44 carried by post 12 at various heights, as shown in FIGS. 1 and 2.

Referring to FIGS. 1 and 2, radio support 18 is carried by elongated post 12 generally between medial level 15 and lower level 17 to provide a space for storing a radio 20 at a convenient location, typically for charging. Generally, radio support 18 is positioned on post 12 clear of the apparel supports and other accessory supports so that the clothing and accessory items may be placed on the post in a function vertical arrangement without overlapping. In the preferred embodiment shown in FIGS. 1 and 2, radio support 18 is carried by post 12 below medial level 15 and above shoe-rack 14 a sufficient height to allow footwear to be placed on shoe-rack 14 clear of radio support 18. Advantageously, radio support 18 is adapted for carrying a charging unit 21 used for charging the batteries of radio 20, shown in outline form. In the preferred embodiment, the radio support is located at a height on the post so as to be in proximity to a wall power outlet 22 so that a power cord 48 of charging unit 21 may be connected to the wall power outlet for charging the radio when placed in the charging unit carried on the radio support. Preferably, radio support 18 is a shelf extending outward from elongated post 12. As best shown in FIG. 2, radio support 18 is positioned or elongated post 12 at a distance above the floor so that power cord 48 from charging unit 21, which is approximately three feet in length, can be connected to wall power outlet 2 for charging the radio. Standard wall power outlets are generally thirteen to twenty-two inches above the floor. Radio support 18 is positioned approximately twelve to forty eight inches from the floor to allow power cord 48 to extend to power outlet 22, while at the same time being located at a sufficient height so as to provide a convenient location for placing radio 20, which is clear of other clothing and accessory items being stored or to be stored on the utility rack.

Referring to microphone mount 24, in the preferred embodiment, microphone mount 24 is carried by elongated post 12 adjacent radio support 18 for storing a microphone 26 operatively associated with radio 20. Preferably, as shown in FIGS. 1 and 2, microphone mount 24 is carried by post 12 in a vertical arrangement above radio support 18 and below medial level 15 so that a cord 27 connecting the microphone to the radio may be maintained in an untangled orderly manner. Microphone mount 24 is generally positioned within eight to twenty-four inches from radio support 18 so that the connection between microphone 26 and radio 20, shown in outline, is sufficient to mount microphone 26 to microphone mount 24 while resting radio 20 on radio support 18. In a further advantageous embodiment illustrated in FIG. 1, both radio support 18 and microphone mount 24 are carried by the post near the medial level on an opposite side of post 12 from storage box 42 and vest hanger 44. This provides balance to the utility rack and organizes the apparel and accessories in such a way that there is no overlap or inference between items.

Referring to FIG. 1, utility belt hanger 38 is carried by elongated post 12 below hat-rack 34 and generally above medial level 15 for storing a utility belt 40, shown in outline form, clear of other clothing and accessory items. Preferably, the utility belt hanger is located adjacent upper level 13. In the preferred embodiment illustrated in FIG. 1, a utility belt hanger support leg 39 extends between hanger 38 and post 12 to provide reinforcing structural support to utility belt hanger 38 as utility belt 40 may be of considerable weight since it is intended to carry numerous items, such as a gun. Preferably, as shown in FIG. 1, utility belt hanger 38 is a round peg extending in a slight upward direction from elongated post 12 a sufficient distance to hold a belt approximately 1–3 inches in width. Because the utility belt hanger is slanted toward the post, utility belt 40 may only slide inward towards post 12 and is prevented from falling to the ground by sliding off the end of utility belt hanger 38. It is to be understood that the present invention is not limited to such a round peg, but rather may be any type of hanger sufficient to support the weight of a utility belt carried by policemen. Generally, utility belt 40 hangs at a distance of at least forty-eight inches from the ground measured from the lowest point of the utility belt when hanging from utility belt hanger 38 to place the belt sufficiently out of the reach of small children. In a further advantageous embodiment, utility belt hanger 38 is carried on an opposite side of post 12 from apparel hook 28 to balance the weight of items hanging on the post between hat-rack 34 and medial level 15.

Figure 4:
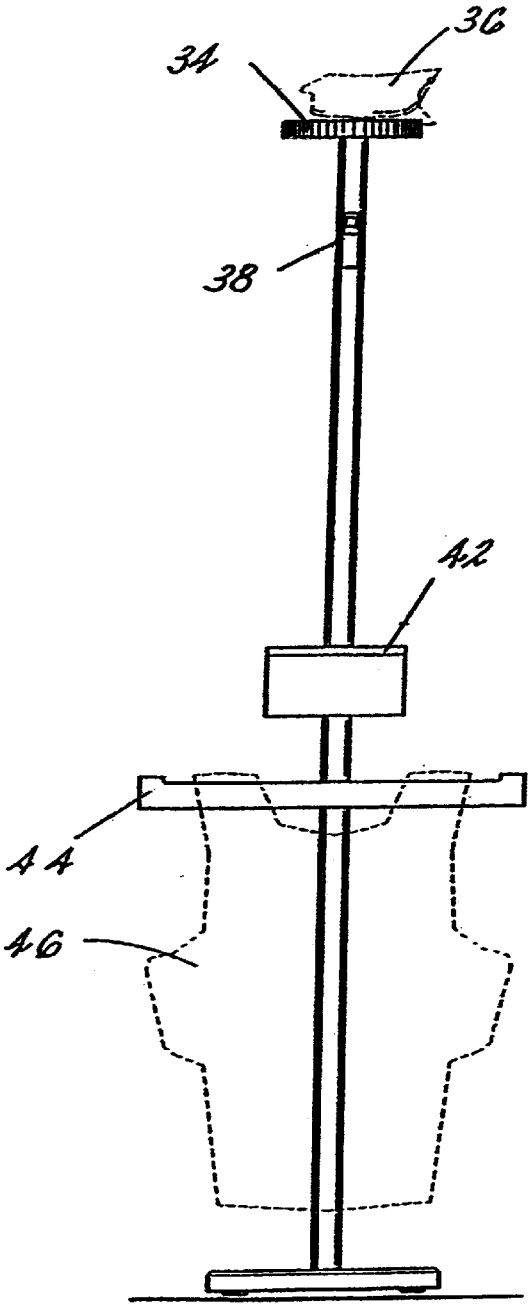
FIG. 4 is a rear view of the utility rack according to the invention.

Referring to FIGS. 1 and 4, vest hanger 44 is carried by elongated post 12 between medial level 15 and lower level 17 for storing a bulletproof vest 46 without interfering in the arrangement of other clothing and accessory items. Preferably, vest hanger 44 is carried in vertical arrangement beneath storage box 42 and on an opposite side of post 12 from radio support 18, microphone mount 24 and shoe-rack 14 so that bulletproof vest 46, shown in outline form, hands clear of other clothing and accessory items on the utility rack. The nature of bulletproof vests make them difficult to fold and store in typical places such as a drawer, and the weight of such the vest puts unusual strain on traditional means of hanging apparel such as coat hangers. As shown in FIG. 1, bulletproof vest 46 hangs freely and conveniently over vest hanger 44 to eliminate the problem of storing the bulky vest. A vest hanger support leg 43 is disposed between vest hanger 44 and elongated post 12 to provide reinforcing support to vest hanger 44 due to the substantial weight of bulletproof vest 46, which is heavier than any other clothing placed on the utility rack. Vest hanger 44 is of sufficient strength and rigidity to support a regulation bulletproof vest. Referring now to FIG. 4, vest hanger 44 includes a transverse hanger bar extending across post 12 for hanging the bulletproof vest. The hanger bar is disposed on an opposite side of the post from the radio support and shoe-rack for carrying said bulletproof vest between the medial level and the base to reduce the likelihood of tipping from the weight of the bulletproof vest. Vest 46 is shown hanging from vest hanger 44 in a manner so that vest 46 is not required to be folded and allows the officer to easily remove the vest for wearing.

In a further advantageous embodiment, storage box 42 is preferably carried by post 12 near medial level 15 for storing miscellaneous equipment normally worn on or used by the personnel. Preferably, as shown in FIG. 1, the storage box is disposed in vertical arrangement below utility belt hanger 38 and above vest hanger 44. Storage box 42 can be used to hold extra equipment such as belt straps, keys, pens, ammunition and other miscellaneous items often carried by policemen. In the preferred embodiment, storage box 42 is simply an open box, but it is understood that the box may include a lid. Additionally, the lid may be used in combination with a locking mechanism to provide added security to storage box 42 and is within the scope and spirit of the present invention.

Figure 3:
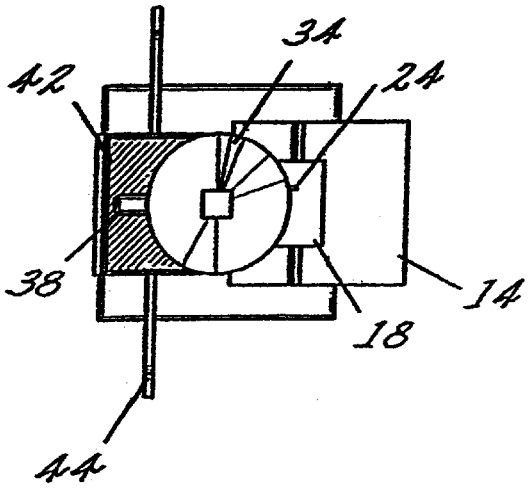
FIG. 3 is a top view of the utility rack according to the invention.

Referring now to FIG. 3, the footprint of the invention is shown from a top view, which as illustrated, allows uniform 30 and all the equipment of a law enforcement officer to be stored in an area with a footprint of preferably less than twenty-four inches by twenty-four inches. Such a small footprint is advantageous for placement in the corner of rooms and closets where space is often a concern.

In describing the general process used by a police officer when donning or removing clothing and accessory items for placement on the utility rack, at the end of a shift, the officer may first remove the miscellaneous items such as ammunition, keys, wallet, badge, or other pocket items and place them in storage box 42. Headwear 36 can be removed and placed conveniently on hat-rack 34 located generally at head-level for an average sized person. Radio 20 can then be removed from utility belt 40, placed on radio support 18, and microphone 26 clipped to microphone mount 24. Next, the officer can remove his footwear and conveniently place it on shoe-rack 14 for storage. Utility belt 40 can be removed and hung on utility belt hanger 38. The jacket and shirt of the uniform can be removed and hung on apparel hook 28. The bulletproof vest can then be removed and placed on vest hanger 44. The pants of the uniform can be removed and placed on a separate hook or the same hook of appear apparel hook 28 thereby allowing the officer to remove the uniform and associated equipment in an efficient order so that each piece of clothing and accessory items can be placed on the utility rack without having to remove other pieces before hanging an item. Therefore, the clothing and accessory items can be removed and placed on the rack without the necessity of temporarily laying the items in other areas prior to organizing them for storage. Additionally, the clothing and accessory items are now hanging on the rack to allow the officer to reverse the process when going on shift to quickly and conveniently get dressed in an orderly fashion without out having to move items around on the rack to select the item to be donned.

Although the preferred embodiment is intended to support the clothing and equipment needs of policemen specifically, the utility rack has further application to supporting the clothing and equipment needs of military personal, security personal, and even the civilian population for use by sportsman and the like where a large amount of gear and apparel must be organized and kept together for storage.

While a preferred embodiment of the invention has been described using specific terms, such description is for illustrative purposes only, and it is to be understood that changes and variations may be made without departing from the spirit or scope of the following claims.

What is claimed is:

1. A utility rack for organizing and storing a variety of clothing items and a variety of accessory items worn and carried by law enforcement personnel, and emergency personnel, said utility rack comprising:

a base;

an elongated post carried by said base, and said post having an upper level, a medial level, and a lower level;

a storage box carried by said post near said medial level for storing miscellaneous equipment normally worn on or used by the personnel;

a plurality of apparel supports carried by said post along the height of said post for organizing the clothing in a functional arrangement, said apparel supports including:

a hat-rack carried by said post adjacent said upper level for storing headwear at a position generally correlated to where the headwear is worn an apparel hook carried by said post below said hat-rack and generally above said medial level for hanging clothing without interfering in the arrangement of other clothing and accessory items; and a shoe-rack carried by said post near said lower level for storing footwear at a position that generally corresponds to the level of where the footwear is worn in order to accommodate the weight of the footwear and facilitate storage of said footwear;

a plurality of accessory supports carried by said post along the height of said post for organizing the accessory items in a functional arrangement, said accessory supports including:

a utility belt hanger carried by said post below said hat-rack and generally above said medial level for storing a utility belt clear of the clothing; and a vest hanger carried by said post near said medial level for storing a bulletproof vest without interfering in the arrangement of other clothing and a radio support carried by said post above said shoe-rack near said medial level on an opposite side of said storage box and said vest hanger for storing a radio at a convenient location for charging; and a microphone mount carried by said post adjacent said radio support near said medial level on an opposite side of said storage box and said vest hanger for storing a microphone operatively associated with said radio;

whereby said apparel supports and accessory supports are disposed at various levels along the height of said post for organizing clothing and accessory items in a functional arrangement generally related to the manner in which the items are usually donned and removed.

2. The rack of claim 1 wherein said elongated post is of a sufficient height so as to allow said clothing and accessory items to be placed on said post in a functional vertical arrangement without overlapping.

3. The rack of claim 1 wherein said hat-rack includes a horizontal hat platform affixed to a top end of said post for storing said headwear.

4. The rack of claim 1 including a plurality of apparel hooks carried below said hat rack and generally above said medial level for storing the clothing in a vertically arranged manner to accommodate hanging and removing the clothing in a prescribed sequence.

5. The rack of claim 4 wherein said apparel hooks include a first apparel hook for hanging a first clothing item, a second apparel hook for hanging a second clothing item; said first and second apparel hooks being functionally arranged so that the clothing may be placed on said apparel hooks in an order to facilitate removal of the clothing in a reverse order when dressing.

6. The rack of claim 5 wherein said utility belt hanger is carried on an opposite side of said post from said apparel hooks to balance the weight of items hanging on said post between said hat-rack and said medial level.

7. The rack of claim 6 wherein said utility belt hanger carries said utility belt at least 48 inches above the ground to prevent small children from reaching said utility belt.

8. The rack of claim 1 wherein said vest hanger is carried by said post below said storage box and above said base.

9. The rack of claim 8 wherein said vest hanger includes a hanger bar extending across said post for hanging said bulletproof vest which has a weight heavier than the clothing placed on said apparel hook; said hanger bar being disposed on an opposite side of said post from said radio support and shoe-rack for carrying said bulletproof vest between said medial level and said base to reduce the likelihood of tipping from the weight of said bulletproof vest.

10. The rack of claim 1 wherein said radio support is carried by said post and is vertically spaced above said shoe-rack.

11. The rack of claim 10 wherein said radio support is adapted for carrying a charging unit used to charge said radio; said radio support being located at a height on said post so as to be in proximity to a wall power outlet so that a power cord of said charging unit may be connected to said wall power outlet for charging said radio when placed in said charging unit on said radio support.

12. The rack of claim 10 wherein said microphone mount is carried by said post in a vertical arrangement above said radio support so that a cord connecting said microphone to said radio may be maintained in an untangled orderly manner.

13. The rack of claim 1 wherein said shoe-rack includes an inclined platform carried by said post above said base near said lower level for receiving footwear; said inclined platform including a heel ridge for abutting the heel of a shoe to prevent said shoes from falling off said inclined platform and causing injury.

14. The rack of claim 1 wherein said base includes a plurality of adjustable footings for leveling said base on uneven flooring.

15. A utility rack for organizing and storing a variety of clothing items and a variety of accessory items worn and carried by law enforcement personnel, and emergency personnel, said utility rack comprising:

a base;

an elongated post carried by said base, and said post having an upper level, a medial level, and a lower level;

a plurality of apparel supports carried by said post along the height of said post for organizing a number of said clothing items in a functional arrangement to facilitate storage and removal of the clothing items;

a plurality of accessory supports carried by said post along the height of said post for organizing a number of said accessory items in a functional arrangement to facilitate storage and removal of the accessory items, said accessory supports including:

a vest hanger carried by said post generally below said medial level and above said base for storing a bulletproof vest without interfering in the arrangement of other clothing and accessory items;

a radio support carried by said post generally between said medial level and said lower level for storing a radio at a convenient location for charging;

said radio support being positioned on said post clear of said apparel supports and other accessory supports so that said clothing and accessory items may be placed on said post in a functional vertical arrangement without overlapping; and a microphone mount carried by said post adjacent said radio support for storing a microphone operatively associated with said radio;

wherein said bulletproof vest has a weight heavier than the weight of the clothing items; and said vest hanger includes a transverse hanger bar disposed on an opposite side of said post from said radio support for carrying said bulletproof vest between said medial level and said base to reduce the likelihood of tipping the weight of said bulletproof vest whereby said apparel supports and accessory supports are disposed at various levels along the height of said post for organizing clothing and accessory items in a functional arrangement generally related to the manner in which the items are usually donned and removed.

16. The rack of claim 15 including a storage box carried by said post near said medial level for storing miscellaneous equipment normally worn on or used by the personnel.

17. The rack of claim 16 wherein said radio support and microphone mount are carried by said post generally between said medial level and said base on an opposite side of said storage box and said vest hanger.

18. The rack of claim 17 said microphone mount is carried by said post in a vertical arrangement above said radio support so that a cord connecting said microphone to said radio may be maintained in an untangled orderly manner.

19. The rack of claim said radio support is adapted for carrying a charging unit used to charge said radio; said radio support being located at a height on said post so as to be in proximity to a wall power outlet so that a power cord of said charging unit may be connected to said wall power outlet for charging said radio when placed in said charging unit on said radio support.

20. The rack of claim 15 including a utility belt hanger carried by said post generally between said upper level and said medial level for storing a utility belt clear of clothing and accessory items placed on said apparel and accessory supports.

21. The rack of claim 20 wherein said utility belt hanger carries said utility belt at least 48 inches above the ground to prevent small children from reaching said utility belt.

* * * * *